US011660774B2

(12) United States Patent
Cochard et al.

(10) Patent No.: US 11,660,774 B2
(45) Date of Patent: May 30, 2023

(54) HOLDING DEVICE FOR A WORKSTATION OF A FORMING MACHINE

(71) Applicant: Bobst (Shanghai) Ltd, Shanghai (CN)

(72) Inventors: Michael Cochard, Salvan (CH); Qiang Fang, Shanghai (CN); Nicolas Panchaud, Sullens (CH); Mingliang Zhou, Shanghai (CN)

(73) Assignee: Bobst (Shanghai) Ltd, Shanghai (CN)

( * ) Notice: Subject to any disclaimer, the term of this patent is extended or adjusted under 35 U.S.C. 154(b) by 951 days.

(21) Appl. No.: 16/469,053

(22) PCT Filed: Dec. 21, 2017

(86) PCT No.: PCT/IB2017/058272
§ 371 (c)(1),
(2) Date: Jun. 12, 2019

(87) PCT Pub. No.: WO2018/116233
PCT Pub. Date: Jun. 28, 2018

(65) Prior Publication Data

US 2019/0308338 A1 Oct. 10, 2019

(30) Foreign Application Priority Data

Dec. 23, 2016 (CN) ..... 201611213582.7

(51) Int. Cl.
*B26D 7/01* (2006.01)
*B31B 50/07* (2017.01)
(Continued)

(52) U.S. Cl.
CPC ..... *B26D 7/018* (2013.01); *B26D 7/18* (2013.01); *B31B 50/07* (2017.08); *B65H 5/085* (2013.01);
(Continued)

(58) Field of Classification Search
CPC ..... B65H 5/085; B65H 2801/42; B65H 2406/351; B26D 7/18; B26D 7/018; B31B 50/07; B31B 50/006; B31B 50/142
See application file for complete search history.

(56) References Cited

U.S. PATENT DOCUMENTS

2014/0184716 A1* 7/2014 Satake ..... B41J 11/0085 271/12

FOREIGN PATENT DOCUMENTS

CN 101108565 A 1/2008
CN 201089229 Y 7/2008
(Continued)

OTHER PUBLICATIONS

Chinese Search Report dated Jul. 23, 2020 in counterpart Chinese Patent Application No. 201611213582.7 (5 pages, in Chinese with English translation).
(Continued)

*Primary Examiner* — Thomas M Wittenschlaeger
(74) *Attorney, Agent, or Firm* — Bookoff McAndrews, PLLC

(57) ABSTRACT

The invention relates to a device (310) for holding a sheet-like element (10) during the stage of introducing it into a workstation (200, 300, 400) of a forming machine (1), such as a waste-ejection station (300), the said holding device (310) comprising a suction member (320) configured so as to partially retain each sheet (10) by its rear part during the stage when the said sheet (10) is introduced into the said workstation (200, 300, 400), characterized in that the suction member (320) has at least two motorized fans (13) with propellers (14) installed transversely at the entrance to the workstation (200, 300, 400), beneath the plane (P) along which the sheet-like elements move, the axes of rotation (A) of the propellers (14) of the fans (13) being substantially parallel to one another and perpendicular to the plane (P)
(Continued)

along which the sheet-like elements move, the direction of rotation and the inclination of the propellers (14) being configured so as to generate a flow of air capable of applying suction to the rear of the lower face of the sheet-like element (10) during the stage in which the said sheet (10) is introduced into the said workstation (200, 300, 400).

20 Claims, 3 Drawing Sheets

(51) Int. Cl.

| | |
|---|---|
| ***B26D 7/18*** | (2006.01) |
| ***B65H 5/08*** | (2006.01) |
| *B31B 50/14* | (2017.01) |
| *B31B 50/00* | (2017.01) |

(52) U.S. Cl.
CPC ..... *B31B 50/006* (2017.08); *B31B 50/142* (2017.08); *B65H 2406/351* (2013.01); *B65H 2801/42* (2013.01)

(56) References Cited

FOREIGN PATENT DOCUMENTS

| | | | | | |
|---|---|---|---|---|---|
| CN | 201619850 | U | | 11/2010 | |
| CN | 103895366 | A | | 7/2014 | |
| CN | 203682679 | U | | 7/2014 | |
| CN | 204054120 | U | | 12/2014 | |
| CN | 205169919 | U | | 4/2016 | |
| CN | 205255589 | U | | 5/2016 | |
| CN | 106219272 | A | | 12/2016 | |
| EP | 1063192 | A2 | * | 12/2000 | ..... B65H 29/247 |
| WO | 2011/160816 | A1 | | 12/2011 | |
| WO | WO-2011160816 | A1 | * | 12/2011 | ..... B25B 11/005 |
| WO | WO-2012105402 | A1 | * | 8/2012 | ..... B31B 1/00 |
| WO | 2016/117808 | A1 | | 7/2016 | |

OTHER PUBLICATIONS

International Search Report issued in related PCT/IB2017/058272, dated Apr. 28, 2018 (2 pages).

* cited by examiner

Fig.3
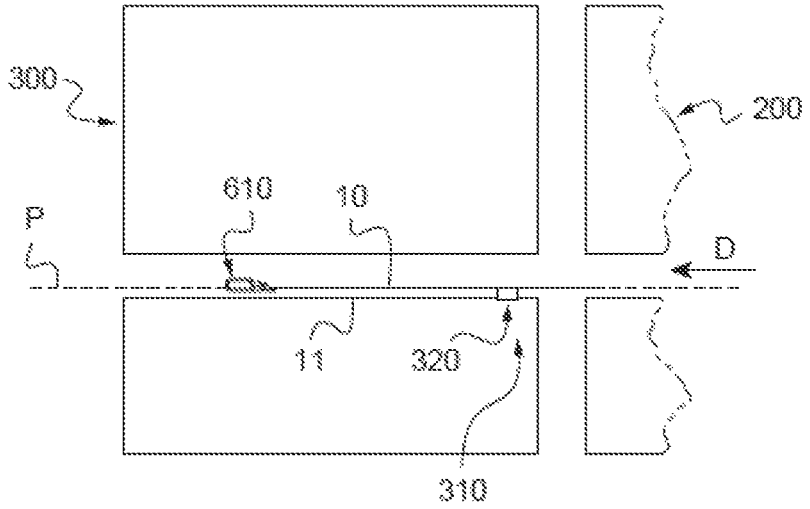
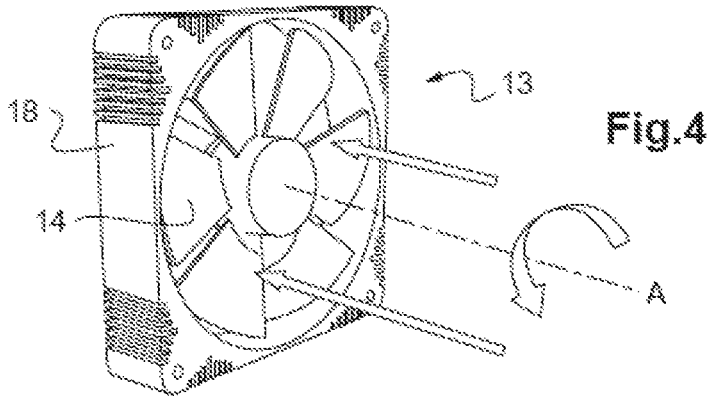
Fig.4
Fig.5
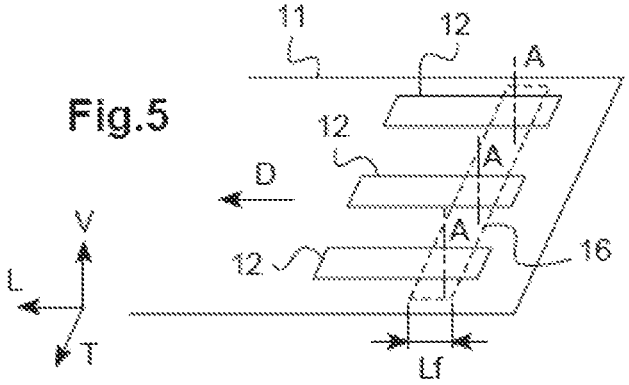

HOLDING DEVICE FOR A WORKSTATION OF A FORMING MACHINE

The present invention relates to a device enabling sheet-like elements to be held when they are introduced one by one into a workstation equipping a forming machine. The invention finds particularly advantageous but non-exclusive application in the field of manufacturing cardboard packaging. The invention also relates to a workstation of a machine for forming sheet-like elements, such as a waste-ejection station, and to a machine for forming sheet-like elements.

It is known to die-cut blanks in a succession of sheets by means of a forming machine, commonly referred to as a die-cutting press. In this type of machine, each sheet is introduced successively into a die-cutting station inside which the actual die-cutting operation takes place, and then into an ejection station where the waste generated in the preceding stage is removed.

In such a waste ejection station, each sheet is introduced individually in a pre-cut form. The blanks have indeed been die-cut but are still attached to one another via attachment points. The same is true for numerous sheet portions which are not used in the final product and are consequently considered as waste.

When a die-cut sheet is decelerated in the ejection station, before coming to a stop between the ejection tools, its rear part naturally tends to catch up its front part which is held by the gripper bar. This phenomenon is particularly acute when the sheets are relatively light and/or have large dimensions.

For whatever reason this might be, the consequence of this is that the flatness of the sheet is deformed substantially, which further increases the risk of being offset relative to the tools. Now it is known that the ejection operation requires precision in the prior positioning of the sheet; the said precision being of course all the greater when the waste is small in size.

In order to overcome this difficulty, it was conceived that each die-cut sheet could be held during its introduction into the ejection station, partially retaining it by its rear part. Systems generating a local suction at the face of the sheet have in particular been developed for this purpose. A Bernoulli tablet, placed transversely at the entrance to the ejection station, may be considered in particular.

This type of arrangement does, however, have the disadvantage of being relatively expensive.

Also, one of the technical problems to overcome by the subject of the present invention is to provide a holding device comprising a suction member capable of partially retaining each sheet by its rear part during the stage of introducing the said sheet into the said workstation, which would make it possible to avoid the problems of the prior art, in particular by offering good suction efficiency at low cost.

To this end, the subject of the present invention is a device for holding a sheet-like element during the stage of introducing it into a workstation of a forming machine, such as a waste-ejection station, the said holding device comprising a suction member configured so as to partially retain each sheet by its rear part during the stage when the said sheet is introduced into the said workstation, characterized in that the suction member has at least two motorized propeller fans installed transversely at the entrance to the workstation, beneath the plane along which the sheet-like elements move, the axes of rotation of the propellers of the fans being substantially parallel to one another and perpendicular to the plan along which the sheet-like elements move, the direction of rotation and the inclination of the propellers being configured so as to generate a flow of air capable of applying suction to the rear of the lower face of the sheet-like element during the stage in which the said sheet is introduced into the said workstation.

The invention as defined in this way has the advantage of generating effective holding of the sheets in the workstation at a relatively low cost.

According to one or more features of the holding device, taken separately or in combination:

the axes of rotation of the fans are implemented transversely in a transverse window with a width of less than ten centimetres, the fans are of the computer fan type, the holding device has between two and fifteen fans in number, the holding device has a support table in which at least two through orifices are formed, the fans being arranged beneath the support table, at least partly opposite the opening of at least one through orifice, the fans are fixed to the support table, the through orifices are oblong holes extending in the longitudinal direction in which the sheets move, additional through orifices are formed in the table support, the holding device has a pilot control unit configured so as to pilot-control the motors of the fans according to a reconfigurable rotational speed of the propellers.

The subject of the invention is also a workstation of a machine for forming sheet-like elements, such as a waste ejection station, characterized in that it has a holding device as defined above.

The subject of the invention is also a machine for forming sheet-like elements, characterized in that it has at least one workstation as described above.

Other advantages and features will become apparent on reading the description of the invention, and from the attached drawings which show a non-limiting exemplary embodiment of the invention and in which:

FIG. 3 is a view substantially similar to FIG. 2 but with the sheet at the end of the stage of introducing it into the waste ejection station.

FIG. 4 shows an example of a fan with which the holding device is provided.

FIG. 5 is a highly schematic view illustrating the arrangement of the axes of rotation of the fans of the holding device relative to the plane in which the sheets move in the forming machine.

Figure 1:
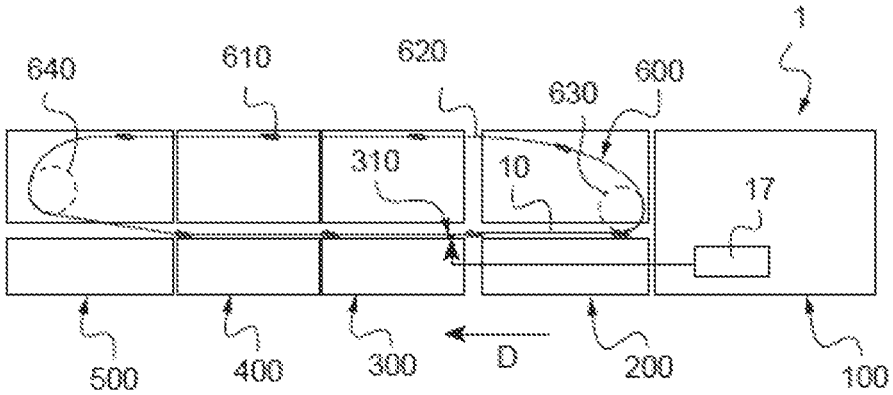
FIG. 1 illustrates a forming machine into which a waste ejection station equipped with a holding device is integrated.

In these drawings, identical elements have the same reference numerals. The following embodiments are examples. Although the description refers to one or more embodiments, this does not necessarily mean that each reference relates to the same embodiment or that the features apply solely to one embodiment. Individual features of different embodiments can also be combined or swapped to provide other embodiments.

It is understood that, throughout this text, the term "sheet" refers very generally to any "sheet-like element" such as, for example, a sheet of paper, compact cardboard, corrugated cardboard, plastic, etc.

The terms "front" and "rear" are defined with reference to the longitudinal direction D in which the sheets move in the forming machine 1. These elements move from the rear to the front, generally following the main longitudinal axis of the machine. The terms "upper" and "lower" are defined with reference to the arrangement of the elements in a forming machine on the ground.

FIG. 1 shows a forming machine 1 enabling blanks to be die-cut from a succession of sheet-like elements 10. These blanks are intended to be later folded and glued to make up packaging boxes.

In this particular embodiment, chosen purely by way of example, the forming machine 1 is classically composed of multiple workstations 100, 200, 300, 400, 500 which are juxtaposed but interdependent in order to form a single unit. Thus, an introduction station 100, a die-cutting station 200, a waste ejection station 300, a receiving station 400 with blank separation, and a station 500 for discharging residual waste can be found. Moreover, the presence of transporting means 600, which are responsible for individually moving each sheet 10 from the exit of the introduction station 100 to the discharging station 500 can be observed.

The number and type of workstations in a forming machine 1 can vary as a function of the nature and complexity of the operations to be performed on the sheets; the receiving station 400 can in particular be omitted.

Figure 2:
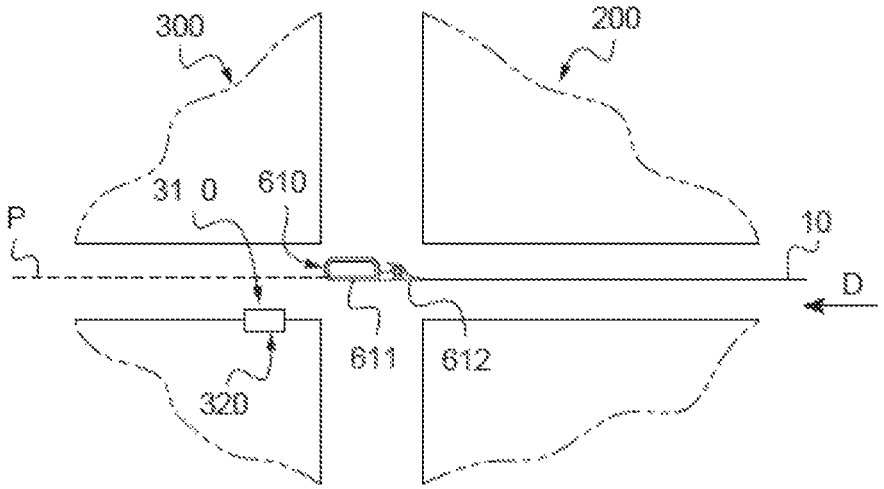
FIG. 2 shows in detail the entrance to the waste ejection station, at the moment when a sheet is ready to be introduced into it.

It should be noted that in all of FIGS. 1 to 3, the different workstations 100, 200, 300, 400, 500 have been shown in a highly schematic fashion. Each of them has indeed been represented by two rectangles which symbolize respectively its upper part and its lower part, these parts being positioned on either side of the plane P in which the sheets move.

Conventionally, the introduction station 100 principally comprises a feeder and a feed table and it is supplied with sheets 10 from a pile stored on a palette. The feeder is more particularly responsible for removing the sheets 10 one by one from the top of the pile and sending them successively onto the directly adjacent feed table. At the feed table, the sheets 10 are placed in a lap, in other words laid one after the other so that they overlap partially. The whole lap is moved along a bed by means of a belt-driven transport system towards the die-cutting station 200. At the end of the lap, the leading sheet 10 is systematically positioned precisely by means of a locating system commonly referred to as a register. Because such an introduction station 100 is perfectly known in the prior art, it will not be described further here. For this same reason, these different components have not been shown in detail in the drawings.

As for the die-cutting station 200, it takes the classical form of a platen press which, in this exemplary embodiment, uses an upper fixed crosshead on the lower face of which a die-cutting tool is integrally formed, and a lower movable crosshead on the upper face of which the upsetting counterpieces are fixed.

The workstation situated just after the die-cutting station 200 is the ejection station 300. The function of the latter is to remove the waste which is directly produced during the die-cutting of the sheets 10. Central waste zones, as well as rear and side strips, are referred to here in particular. Whatever the case, this operation classically takes place here owing to the interaction of three elements, namely an upper ejection tool, a central ejection board, and a lower ejection tool.

Downstream from the ejection station 300 is situated the receiving station 400, the main function of which consists in breaking the attachment points between the blanks by means of an upper male tool and a lower female tool. There is a dual purpose, namely to separate the blanks from one another and to make piles of blanks which can be processed subsequently by folding and gluing machines.

The process of processing the sheets 10 in the forming machine 1 ends in the discharging station 500 where the residual waste is discharged. The latter is released automatically and then discharged from the discharging station 500 by a belt.

The forming machine 1 has transporting means 600 which allow each sheet 10 to be moved individually from the exit of the introduction station 100 to the discharging station 500.

In a fashion which is also very conventional, the transporting means 600 use a series of gripper bars 610 which are mounted so that they can move in transverse translation by means of two sets of chains 620 arranged laterally on each side of the forming machine 1. Each set of chains 620 runs in a loop which allows the gripper bars 610 to follow a trajectory which passes successively through the die-cutting station 200, the ejection station 300, the receiving station 400, and the discharging station 500.

Concretely, each gripper bar 610 passes in a substantially horizontal plane of movement between a drive wheel 630 and a return wheel 640, and then a returns in the upper part of the forming machine 1. Once it has been returned to the drive wheel 630, each gripper bar 610 is then capable of gripping a new sheet 10. As can be seen more clearly in FIG. 2, each gripper bar 610 consists of a transverse bar 611 on which are mounted multiple grippers 612 which are designed so as to be able to grip the front edge of a same sheet 10 simultaneously. Each gripper bar 610 is coupled to two sets of chains 620 via the two ends of its transverse bar 611.

FIGS. 1 to 3 show that the ejection station 300 is moreover equipped with a device 310 for holding each sheet 10 during its introduction stage. This holding device 310 comprises a suction member 320 which is responsible for partially retaining each sheet 10 by its rear part during the stage of introducing it into the ejection station 300. Concretely, the suction member 320 holds the rear part of the sheet 10 without immobilizing it, allowing it to slide gradually as it moves in accordance with FIG. 3.

In order to do this, the suction member 320 has at least two motorized fans 13 with propellers 14. The fans 13 are advantageously small commercially available fans, of the computer fan type, the propeller 14 being mounted rotatably in a frame 18 provided with screw fixing means (FIG. 4). The fans 13 can all be identical.

The fans 13 are installed transversely at the entrance to the ejection station 300, at the lower part of the station 300 so as to be positioned beneath the plane of movement P of the sheets, and hence be able to act in the region of the lower face of the latter (FIG. 3). The fans 13 are distributed in a transverse direction T perpendicular to the longitudinal direction D of movement of the sheets in the forming machine 1 (FIG. 5).

The axes of rotation A of the fans 13 are juxtaposed in order to cover substantially the whole width of the sheet 10. They can be perfectly aligned or be installed in a longitudinally narrow transverse window 16, the width Lf of which is, for example, less than ten centimetres. They may or may not be regularly spaced in the transverse direction T.

The axes of rotation A of the propellers 14 of the fans 13 are arranged substantially parallel to one another and perpendicularly to the plane of movement P of the sheets.

The direction of rotation of the propellers 14 and the orientation of the propellers 14 of the fans 13 are configured so as to generate, when functioning, a flow of air which is capable of applying suction to the rear of the sheet-like element 10 during the stage of introducing the said sheet 10 into the said waste ejection station 300.

The number of fans 13 may lie between two and fifteen. It can be adjusted depending on the material of the sheets 10 and on their sizes in order to successfully retain the sheet and to generate a flow of air over substantially the whole width of each sheet 10 which is introduced into the waste ejection station 300.

Figure 6:
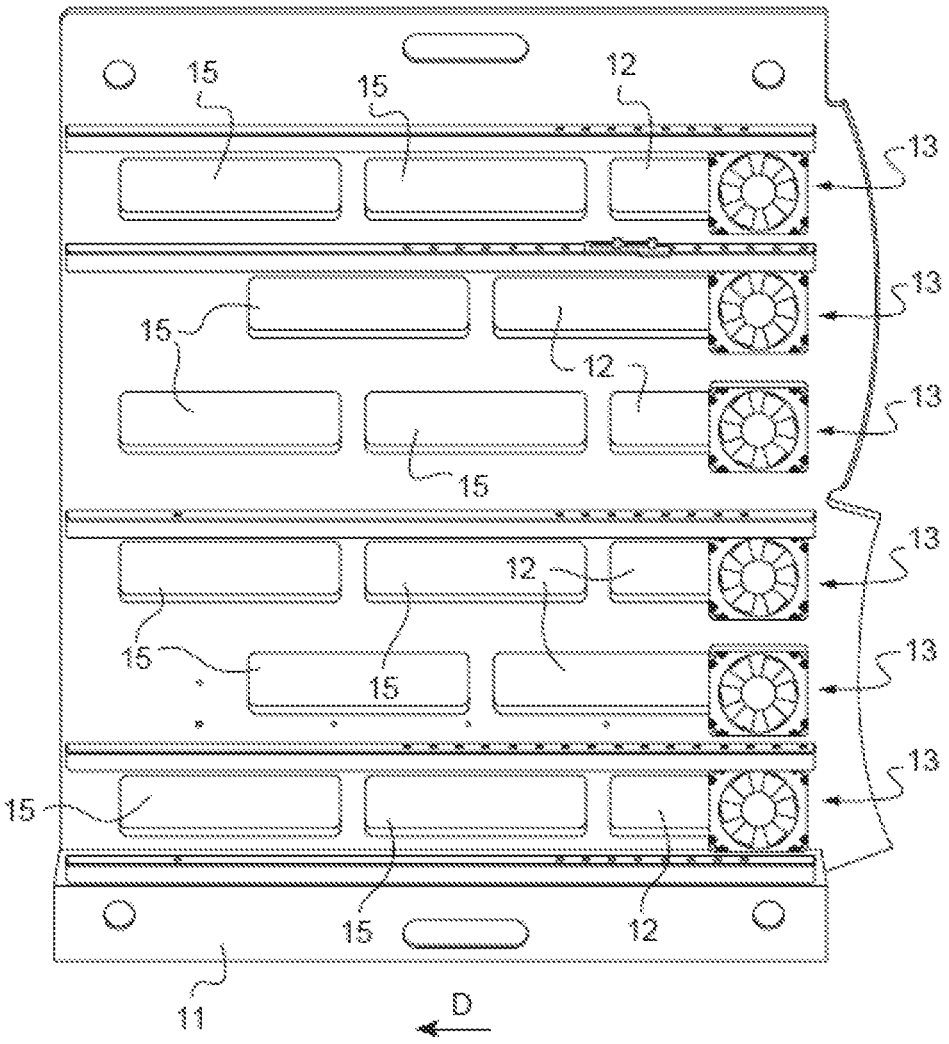
FIG. 6 shows a view from below of an exemplary embodiment of the holding device equipped with a support table to which the fans of the holding device are fixed.

The holding device 310 can have a support table 11 in which at least two through orifices 12 are formed, the fans 13 being arranged beneath the support table 11, at least partly opposite the opening of at least one through orifice 12 (FIG. 6).

The support table 11 is a flat element arranged beneath the plane of movement P of the sheets. This can be a plate pierced with through orifices 12, or a grid. The support table 11 can be a separate element of the frame of the waste ejection station 300 or can be entirely integrated into the frame. The fans 13 can be fixed directly beneath the support table 11. When the support table 11 is a separate element, it is thus possible to easily equip workstations which are initially not provided with a system for holding the rear parts of the sheets.

This fixing of the fans 13 can be removable, which can make it possible to adapt the number of fans 13 fixed beneath the support table 11 depending on the forming operations 1 which are performed in the machine. This feature does indeed offer the possibility of increasing the number of fans 13 for large-size sheets 10 or reducing the number of fans 13 for low speeds and/or when working with relatively rigid sheets 10.

The through orifices 12 are, for example, oblong holes extending in the longitudinal direction of movement D of the sheets. The through orifices 12 can be identical.

Additional through orifices 15 can be formed in the support table 11, the number of orifices 12, 15 then being greater than the number of fans 13. The additional orifices 15 are, for example, likewise oblong holes which are elongated in the same direction as the oblong through orifices 12 communicating with the fans 13. The additional orifices 15 enable cushions of air to be formed between the sheet 10 and the support table 11.

The holding device 310 can have a pilot control unit 17 configured so as to pilot-control the drive motors in rotation of the fans 13. The pilot control unit 17, such as a computer, a controller or a microcontroller, such as the computer of the forming machine 1, has memories and programs which enable a series of instructions to be performed, in particular in order to pilot-control the stopping and starting of the fans 13.

The fans 13 can be pilot-controlled by the pilot control unit 17 in order to function continuously, this being adapted for forming machines 1 functioning at very high speeds. It is, however, of course possible to provide a more or less discontinuous functioning mode of the fans 13. In the same fashion, the fans 13 can function at constant power but it is perfectly possible to contemplate operating the fans 13 at a variable power level. This variable power can be obtained by varying the rotational speed of the propellers 14 of the fans 13. This speed can be the same for all of the fans 13. It can be reconfigured by the operator in particular to adapt the suction power of the fans 13 to the size and weight of the sheets 10 formed in the machine 1.

The invention as defined has the advantage of generating effective holding of the sheets in the workstation at a relatively low cost. This ultimately allows the forming machine to be operated at high speed.

Of course, the invention also relates to any workstation 200, 300, 400 intended to equip a forming machine 1 and having a holding device 310 as described above. A waste ejection station 300 as in the particular embodiment chosen to illustrate the invention can be considered in particular here, but so too can a die-cutting station 200 or a receiving station 400 with blank separation.

However, even more generally, the invention furthermore relates to any forming machine 1 equipped with at least one workstation 200, 300, 400.

The invention claimed is:

1. A holding device for holding a sheet during introduction of the sheet into a workstation of a forming machine, the holding device comprising:

a support table to face a lower face of the sheet, and to remain stationary during the introduction of the sheet into the workstation;

at least one through orifice in the support table;

at least one additional through orifice in the support table, and elongated in a same direction as the at least one through orifice; and a suction member configured to partially retain a rear part of the sheet during the introduction of the sheet into an entrance of the workstation, wherein the suction member has at least two motorized fans with propellers, wherein the at least two motorized fans are arranged beneath the at least one through orifice in the support table, installed transversely at the entrance to the workstation, and installed beneath a plane along which the sheet moves, wherein no fan is beneath the at least one additional through orifice, wherein axes of rotation of the propellers of the at least two motorized fans are substantially parallel to one another and perpendicular to the plane along which the sheet moves, and wherein a direction of rotation and inclination of the propellers is configured to generate a flow of air to apply suction to the rear part of the sheet on the lower face of the sheet during the introduction of the sheet into the entrance of the workstation.

2. The holding device of claim 1, wherein the axes of rotation of the at least two motorized fans are implemented transversely in a transverse window with a width less than ten centimeters.

3. The holding device of claim 1, wherein the at least two motorized fans are of the computer fan type.

4. The holding device of claim 1, wherein the at least two motorized fans include between two and fifteen fans in number.

5. The holding device of claim 1, wherein the at least one through orifice includes at least two through orifices, the at least two motorized fans being arranged at least partly opposite an opening of at least one through orifice.

6. The holding device of claim 5, wherein the at least two motorized fans are fixed to the support table.

7. The holding device of claim 5, wherein the at least two through orifices are oblong holes extending in a longitudinal direction of a movement of the sheet.

8. The holding device of claim 5, wherein the at least one additional through orifice enables a cushion of air to be formed between the sheet and the support table.

9. The holding device of claim 1, further comprising:

a pilot-control unit configured to pilot-control motors of the at least two motorized fans according to a reconfigurable rotational speed of the propellers.

10. A workstation of a machine for forming a sheet, the workstation including a holding device as claimed in claim 1.

11. A machine for forming a sheet, the machine including at least one workstation as claimed in claim 10.

12. A holding device comprising:

a suction member configured to generate a flow of air to apply suction to a lower face of a sheet, the sheet being moved by a transport system on an upper face of the sheet that moves with the sheet through a workstation; and a support table below the sheet, the support table including a first through orifice and a second through orifice, wherein the suction member includes a fan arranged beneath a plane along which the sheet moves, wherein no fan is associated with the second through orifice, wherein an axis of rotation of the fan is perpendicular to the plane along which the sheet moves, and wherein the fan is configured to generate the flow of air through the first through orifice to apply suction to the lower face of the sheet.

13. The holding device of claim 12, wherein the fan is associated with only the first through orifice among all through orifices of the support table.

14. A workstation comprising:

the holding device of claim 12; and the transport system.

15. The workstation of claim 14, wherein the transport system includes a gripper configured to grip the upper face of the sheet to move the sheet through the workstation.

16. A holding device comprising:

a support table including a first orifice and a second orifice; and a fan fixed to a first side of the support table, wherein the fan is configured to rotate to generate a suction force through the first orifice to a second side of the support table opposite to the first side, wherein no fan is associated with the second orifice, and wherein the suction force is configured to pull a sheet toward the support table and away from a transport system that moves with the sheet through a workstation.

17. The holding device of claim 16, wherein the transport system includes a gripper configured to grip the sheet to move the sheet through the workstation, and the sheet is provided between the gripper and the support table as the sheet and the gripper move through the workstation.

18. The holding device of claim 17, wherein when the sheet is positioned in the workstation, the fan is positioned on the support table at a rear portion of the sheet and the gripper is positioned at a front portion of the sheet.

19. The holding device of claim 16, wherein each of the first orifice and the second orifice extends to a top surface of the second side of the support table.

20. The holding device of claim 16, further comprising:

a controller configured to operate the fan at a variable power level based on a size and a weight of the sheet.

* * * * *